United States Patent [19]

Takabayashi

[11] Patent Number: 4,608,906

[45] Date of Patent: Sep. 2, 1986

[54] TREMOLO APPARATUS FOR AN ELECTRIC GUITAR

[75] Inventor: Youjiro Takabayashi, Hamamatsu, Japan

[73] Assignee: Nippon Gakki Co., Ltd., Shizuoka, Japan

[21] Appl. No.: 751,629

[22] Filed: Jul. 2, 1985

[30] Foreign Application Priority Data

| | | | |
|---|---|---|---|
| Jul. 6, 1984 | [JP] | Japan | 59-101429 |
| Sep. 5, 1984 | [JP] | Japan | 59-133969 |
| Sep. 5, 1984 | [JP] | Japan | 59-133970 |

[51] Int. Cl.[4] ..... G10D 3/00

[52] U.S. Cl. ..... 84/313; 84/297 R; 84/298; 84/312 R

[58] Field of Search ..... 84/297 R, 298, 299, 84/312 R, 313

[56] References Cited

U.S. PATENT DOCUMENTS

| | | | |
|---|---|---|---|
| 4,171,661 | 10/1979 | Rose | 84/313 |
| 4,497,236 | 2/1985 | Rose | 84/298 |

*Primary Examiner*—Benjamin R. Fuller

*Attorney, Agent, or Firm*—Koda and Androlia

[57] ABSTRACT

A tremolo unit mechanism for electric guitar comprising bridge bodies respectively provided on a bridge base which correspond to respective strings, each of the bridge bodies having a slanted top surface and a string inserting hole. A rocker arm is mounted on the bridge body which pivotally moves in a vertical direction to firmly press the string with the front end portion of the slanted top surface of the bridge body when a locking screw is screwed into the rear end of the rocker arm and press the rear end of the bridge body. An octave tuning screw is connected to the bridge body, which moves the bridge body in the length-wise direction of the string to effect harmonic tuning of the string. A string locking device is provided between the nut and the tuning pegs. The string locking device includes a height adjusting spacer and a string locking block which is provided on the spacer and has front and rear walls with a space in between. The front wall is provided with V-shaped grooves and the rear wall has inclined holes which bring the strings close to the head surface.

14 Claims, 10 Drawing Figures

TREMOLO APPARATUS FOR AN ELECTRIC GUITAR

BACKGROUND OF THE INVENTION

1. Field of the Invention

The present invention relates to a tremolo apparatus for an electric guitar equipped with the function to hold the strings against the bridge.

2. Prior Art

As is known widely, when strings are lowered in tension, the frequency of vibration decreases, while, on the contrary, when the tension of the strings is heightened, the frequency of vibration increases. Therefore, in an electric guitar, it is designed to obtain a specific sound effect, that is a so-called tremolo effect, through lowering and heightening the pitch by changing the tension of the string with quick repetition by using a tremolo mechanism.

In general, the tremolo unit mechanism is constructed as follows: A bridge is disposed on the body of an electric guitar in a flexibly rotatable manner. This bridge base is held in balance with the moment created by the tension of the strings by the use of a balancing spring. Also, string holding members are disposed on the bridge base in a manner to be freely controlled in their movement along the stretching direction of the strings. One end of the strings is anchored to the foregoing string holding member, or the portion around the end of the string is supported by the string holding member, and the above mentioned bridge base is moved up and down by a tremolo arm.

In construction, however, the guitar soon becomes out of tune when vigorous arming is done in the play, thus posing the problem in actual use.

As a countermeasure to such inconvenience, for example, the U.S. Pat. No. 4,171,661 is known. This invention provides a guitar wherein the portion of the string, that is supported by the string holding member, is locked by pressing it with a presser block in order to prevent the guitar from getting out of tune. Still, the guitar provided by this invention has a problem in terms of handling efficiency. That is, in case the tuning becomes deranged by some reason, it requires troublesome correcting handlings. It needs retuning by releasing the lock of the string effected by the presser block, then the strings must be retuned by tuning pegs and then the string must be locked again with the presser block, through loosening and tightening screws. Besides, the ball end of the string has to be cut first, then, after the string is inserted into the string holder, the presser block must be clamped against the string holding member with the screw and needs appropriate tools, such as a driver, nipper, etc. Thus, complicated steps must be taken for locking and unlocking of the strings.

Furthermore, the U.S. Pat. No. 4,497,236 discloses a mechanism enabling the tuning to be done while the string is in the locked state, for the purpose of improving the handling efficiency in tuning operation after the string is locked. However, the problems still remain in this mechanism too. The ball end must be cut off and a lot of force is required for fixing the string. Also, for harmonic tuning, the screw used for fixing the string holding member to the bridge base must be loosened, and the string holding member must be moved by hand to the appropriate position. Then, the screw needs to be tightened again. Thus, the handling is difficult with additional disadvantage of lowered accuracy in positional adjustment.

In addition to those mentioned above, various devices for fixing the strings between tuning pegs and nuts have been provided in order to prevent the loosening of the strings during playing of the guitar.

FIG. 1 shows an example of such devices. In a guitar provided with this device, the string locking body 202 is formed into approximately U shape in section. This sectional shaping formed by a long groove 201 provided along the top surface thereof. A pair of front and rear side walls 202A and 202B of the string locking body 205 are provided, respectively, with through holes 203 and 204 for inserting a string. These through holes 203 and 204 are opened to the foregoing long groove 201. The string locking body 205 thus constructed is mounted on the upper surface of the head portion 206A of the neck 206 by means of a set screw 207. Also, a presser block 208 that is loosely inserted to the long groove 201 is pressed by a clamping screw 209. This way, the string 210 in the long groove 201 is fixed by getting pressed. The numeral 211 is a finger board, 212 is a top nut, 213 is a tapped hole, and 214 is a through hole.

In the string locking device 202 as mentioned above, when the bottom surface of the long groove 201 is positioned too low relative to the top nut 212 position, the string pressure becomes high, thus tending to lift the presser block 208. This in turn causes the tendency to form the gap between the string 210 and the bottom surface of the long groove 201. As a result, there occurs a problem that when the presser block 208 is lowered to clamp the string, the minute variation in pitch is caused. Moreover, since this device is constructed such that the through holes 203 and 204 for inserting the string are formed respectively in the side walls 202A and 202B, it is difficult to clearly see if the gap is formed between the bottom surface of the long groove 201 and the string 210, even though it is tried to confirm it by looking from the front or rear sides or from above.

SUMMARY OF THE INVENTION

In light of the problems in the existing string locking structure, it is an object of the present invention to provide a tremolo apparatus for an electric guitar that is capable of effecting the locking of strings reliably with simple handling which requires only moderate force and also makes it possible to do the locking work without using any tool.

Another object of the present invention is to provide a tremolo apparatus for an electric guitar that makes it unnecessary to cut the ball end of the string during the locking work.

A further object of the present invention is to provide a tremolo apparatus for an electric guitar that enables the stretching work for the strings to be performed only on the top surface side of the guitar.

Still a further object of the present invention is to provide a tremolo apparatus for an electric guitar that facilitates the handling for harmonic tuning and brings about the improvement in accuracy of the tuning.

An even further object of the present invention is to provide a tremolo apparatus for an electric guitar that allows the implementation of the fine tuning while the strings are kept in the locked state.

An additional object of the present invention is to provide a tremolo apparatus for an electric guitar that makes it feasible to prevent the pitch from becoming out of tune in the way of locking the string stretched between the tuning peg and the nut.

A further additional object of the present invention is to provide a tremolo apparatus for an electric guitar that allows the checking to be carried out easily as to the locking state of the string stretched between the tuning peg and the nut.

The above and other objects and features of the present invention are accomplished by a unique structure for a tremolo apparatus for an electric guitar as follows:

Each bridge body is disposed on a bridge base such that the bridge body is controlled in its movement toward front and back by means of a harmonic tuning (octave tuning) screw. This bridge body is provided with a through hole for inserting a string and also with a rocker arm. The through hole for inserting a string is designed to lead the string from the back side of the bridge body to the upper surface of the front end of the bridge body. The rocker arm is disposed on the bridge body to cover the upper surface of the bridge body and to be optionally rotated upward and downward. The swing (or rotation) of the rocker arm is effected by a lock screw that is screwed into the rear end portion of the rocker arm with its end in contact with the upper surface of the rear end portion of the bridge body. With its front end, the rocker arm presses and fixes the string onto the upper surface of the front end portion of the bridge body.

Also, in another embodiment of the present invention, in place of the foregoing bridge body, a harmonic tuning member is disposed on the bridge base. This harmonic tuning member can be controlled in its movement toward front and back by means of a harmonic tuning screw. This harmonic turning member is provided with a string holding member which is disposed to be freely swung upward and downward. On this string holding member, a rocker arm as mentioned above is disposed by a lock screw. Through swinging the string holding member, the fine tuning can be effected The structure for locking the string between the tuning peg and the nut includes a string locking body which is disposed on the top surface of the head portion with a spacer for adjusting the height interposed in between. Of a pair of front and back side walls formed on the top surface of the string locking body, the side wall on the front side is provided with approximately a V-shaped groove, while the side wall on the rear side is provided with a slanted hole that is formed in order to bend the string inserted into it toward the head portion.

DETAILED DESCRIPTION OF THE INVENTION

Figure 1:
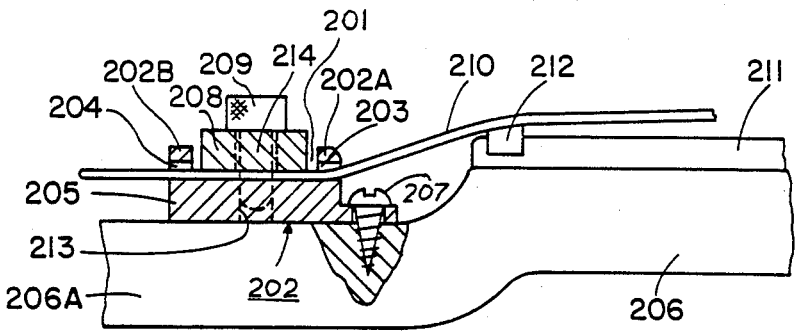
FIG. 1 PRIOR ART
FIG. 1 is a sectional side elevation showing an example of conventional string locking devices.
Figure 2:
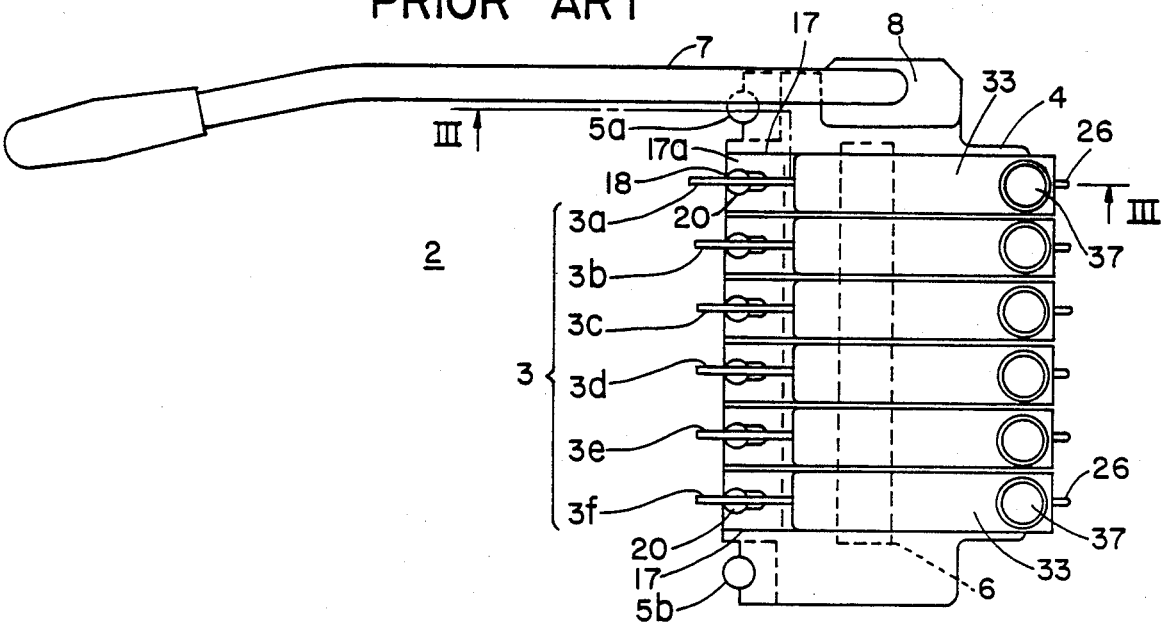
FIG. 2 is a plan view of a tremolo apparatus of the present invention.
Figure 3:
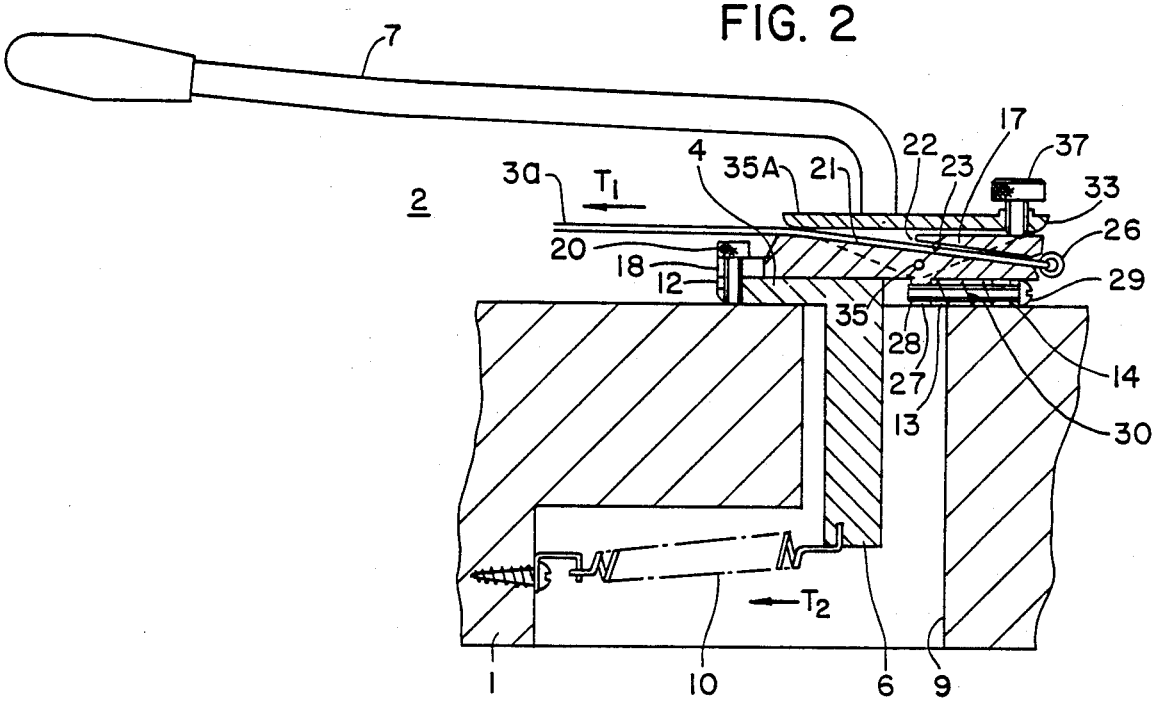
FIG. 3 is a sectional view taken along the line III—III in FIG. 2.
Figure 4:
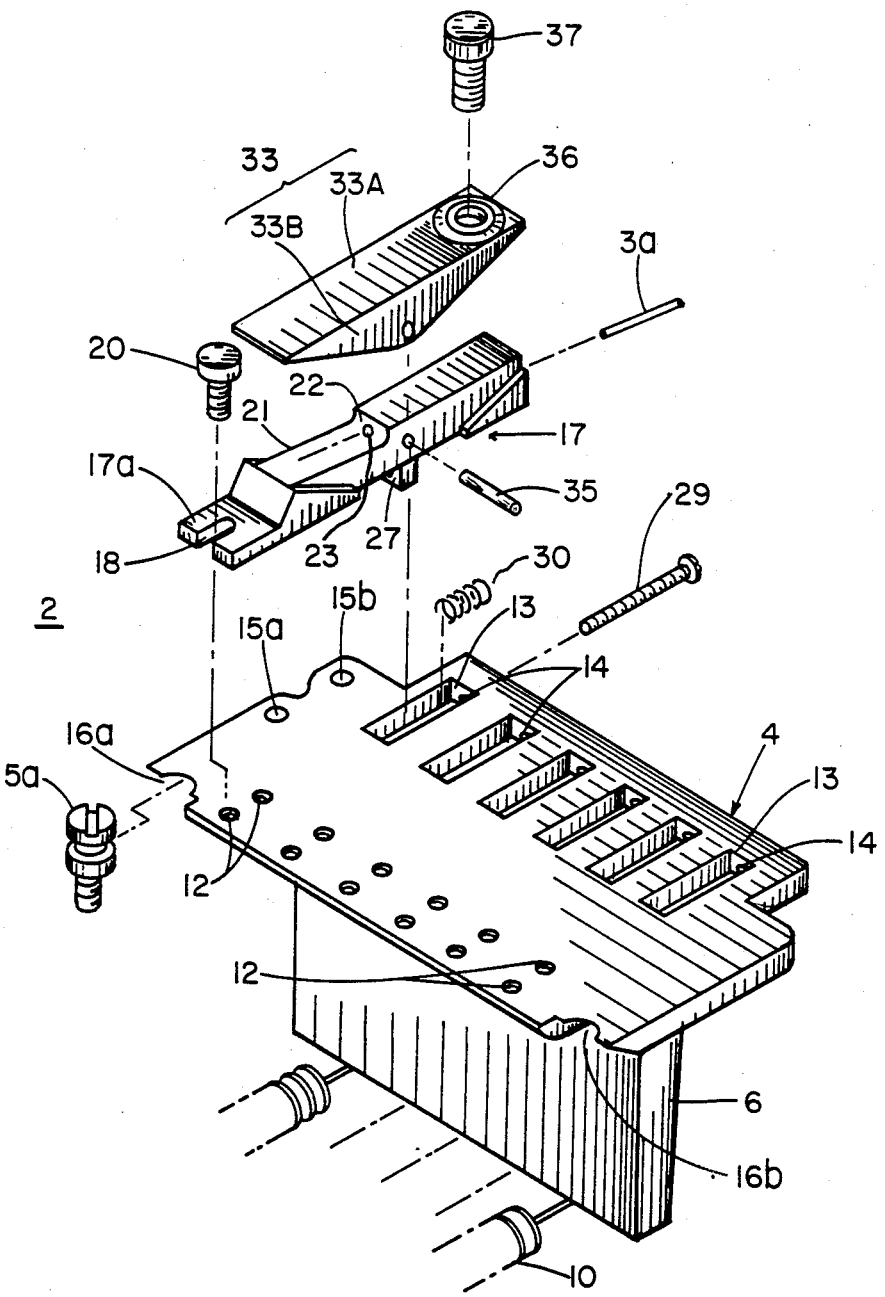
FIG. 4 is an exploded perspective view of the main components of the tremolo apparatus shown in FIG. 2.

FIG. 2 is a plan view showing a tremolo unit mechanism as an embodiment according to the present invention. FIG. 3 is a sectional view taken along the line III—III in FIG. 2. FIG. 4 is an exploded perspective view of the main component members of the tremolo unit mechanism mentioned above.

In these Figures, the reference numeral 1 is a body of an electric guitar. On the top of the body 1, a tremolo unit mechanism 2 for holding one end of a plural number of strings 3, e.g. six strings 3a through 3f, is provided.

The tremolo unit mechanism 2 includes among other components a bridge base 4. This bridge base 4, formed into a board of approximately T-shape in side view, includes a spring anchoring portion 6 that is in a form of being suspended from the center of the underside of the bridge base 4. The bridge base 4 is disposed on the body 1 in a manner to swing freely along the vertical direction with its front end used as a supporting point for such swing. Onto the body 1, a pair of right and left columns 5*a* and 5*b* are planted, and both sides of the front end face of the bridge base 4 come to contact with these columns 5*a* and 5*b*. Through the foregoing contact with the columns 5*a* and 5*b*, the bridge body 4 is restricted and prevented against its movement toward the left side in the drawing, that is, toward the head (not shown in the Figures) of the electric guitar, when such movement is caused due to the tensile force of the strings 3. To the side edge on the first string 3*a* side of the bridge base 4, a tremolo arm 7 is fastened with an arm block 8 interposed in between.

The aforementioned spring anchoring portion 6 is inserted and positioned in a spring housing chamber 9 formed in the body 1. To the lower end of the spring anchoring portion 6, one end of the balancing springs 10, for example five, which have the same spring force of each other, are anchored respectively. By means of these springs 10, a propensity (momentum) to swing in a clockwise direction (in FIG. 3) is provided for the bridge base 4, with a pair of columns 5*a* and 5*b* mentioned above used as a rotational fulcrum. In this manner, balancing with the tensile force by the strings 3 referred to previously is effected.

The bridge base 4 is provided, along the upper surfaces of its front end portion and rear end portion, with twelve tapped holes 12 and six long holes 13, respectively. The tapped holes 12 and the long holes 13 are formed in accordance with the respective strings 3*a* through 3*f*, in a manner to open to the upper surface of the front end portion and to the upper surface of the rear end portion of the bridge base 4, respectively. Furthermore, at the back side of the bridge base 4, screw fitting holes 14 which are opened respectively to the foregoing respective long holes 13 are formed. Also, at both side areas of the front end face 16*a* and 16*b* of the bridge base 4, with which the above mentioned columns 5*a* and 5*b* are in contact, semicircular cutouts as shown in FIG. 4 are formed. The underside of these semicircular cutouts are cut into forming a slant toward the rear. Thus, the edge is formed for each of those semicircular cutouts, and these edges are in linear contact with the circumferential surfaces of the foregoing columns 5*a* and 5*b*, respectively. Those denoted by 15*a* and 15*b* are the tapped holes for fixing the arm block 8.

On the bridge base 4 thus constructed, bridge bodies 17 are disposed by corresponding to the respective strings 3*a* through 3*f*. The bridge body 17 is formed to be long in longitudinal (front and back) direction. At the front end of the bridge body 17, a thin portion 17*a* having a U-shape groove 18 is provided in a protruding form as an integral part of the bridge body 17. Into the U-shape groove 18, a set screw 20 is inserted, and this set screw 20 is screwed into the previously mentioned tapped hole 12. This way, the bridge body 17 is fixed onto the bridge base 4 in a manner to be optionally adjusted in its frontward and backward movement.

The upper surface of the front end portion 21 of the bridge body 17 is formed into a slant by sloping it with an appropriate angle (about seven degrees) so that the thickness of this front portion of the bridge body 17 is gradually reduced toward the back. To a rising wall 22 which raises from the terminal end of this slanted surface of the front end portion 21, one end of a string inserting hole 23 is opened, and the other end of the hole 23 is opened to the backside of the bridge body 17. The foregoing slope of the front end portion 21 and the string inserting hole 23 are formed equal in tilting angles, with the design that the lower end of the string inserting hole 23 lies in the same plane with the surface of the slope of the front end portion 21.

The string 3 is inserted from the back side of the bridge body 17 into the foregoing string inserting hole 23, and made to come into contact closely with the abovementioned slope of the front end portion 21. The end of the inserted string 3 is wound on and thus anchored to the tuning peg (not shown in the Figures) of the neck. Through this winding over the tuning peg, the string 3 is adjusted into having the specified tension. In this case, the string 3 is prevented from slipping out of the string inserting hole 23 by means of a ball end 26 attached to the end of the string 3.

At approximately the center of the underside of the bridge body 17, a coupling portion 27 having a tapped hole 28 is formed in a manner to be suspended from the abovementioned center area. This coupling portion 27 is formed as an integral part of the bridge body 17. The coupling portion 27 thus provided is inserted to the long hole 13 formed in the bridge base 4. In this manner, the bridge body 17 is restricted and prevented against its swinging movement to the left and right sides. Also, the coupling portion 27 and the bridge base 4 are coupled by an octave (harmony) tuning screw 29 which is screwed into the tapped hole 28 from the screw fitting hole 14 formed at the back side of the bridge base 4. When this screw 29 is rotated for adjustment while the above mentioned set screw 20 is kept in the loosened state, the bridge body 17 is moved and adjusted in forward and backward directions. Thus, the octave (harmony) pitch of the string 3 can be adjusted into tuning. A helical compression spring 30 is mounted around the above mentioned octave (harmonic) tuning screw 29, and it prevents the loosening of the octave tuning screw 29 by giving the frontward momentum to the bridge body 17.

The bridge body 17 mentioned above is provided with a rocker arm 33 for locking the string 3. This rocker arm 33 is constructed of a base plate 33A and a pair of right and left side plates 33B. The base plate 33A cover the top surface of the bridge body 17, and the side plates 33B are formed as integral parts of the rocker arm 33. Each of the foregoing side plates 33B is formed into an inverted triangle, and they respectively extend downward from the base plate 33A along both side surfaces of the bridge body 17. Because of the structure thus designed, the rocker arm 33 has an approximately ⊐-shape in its sectional view. The center portions on the lower side of a pair of side plates 33B mentioned above are pivotally supported on the bridge body 17 by means of a shaft 35 in a manner to swing freely in the vertical direction (toward the front and back).

At the rear end portion of the base plate 33A, a tapped hole 36 is formed, and into this tapped hole 36, a locking screw 37 is screwed. When this locking screw 37 is screwed in, its end comes into contact with the upper surface of the rear end portion of the bridge body 17. When, after coming into contact with the upper surface of the rear end portion of the bridge body 17, the locking screw 37 is further screwed in, the rocker arm 33 is rotated counterclockwise in Figure with the shaft 35 serving as center. As a result, the front end of the base plate 33A contacts the string 3 on the upper surface of the front end area of the bridge body 17, in pressing manner, thereby locking the string 3.

In the tremolo unit mechanism 2 having the structure as mentioned above, the counterclockwise (in FIG. 3) moment T1 provided by the sum total of the tensile forces of the respective strings 3*a* through 3*f* is balanced at a certain point with the clockwise moment T2 resulted from the sum total of the spring forces of the five balancing springs 10. Thus, the bridge base 4 is held lightly in contact with the body 1 or kept in a state being positioned and angled to be somewhat lifted over the body 1. In this state, when the tremolo arm 7 is moved up and down during guitar playing, the bridge base 4 moves up and down with the columns 5*a* and 5*b* functioning as the fulcrum for swinging. This causes the variation in the tensile force of each of the strings 3*a* through 3*f*, providing the tremolo effect. In this case, since the string 3 is pressed and fixed onto the top surface of the bridge body 17 by means of the rocker arm 33, the pitch will not be deranged to be out of tune even if the vigorous arming is done.

Also, since the locking screw 37 is located far from the shaft 35, according to the principles of the lever and fulcrum, the pressing force of the rocker arm 33 onto the string 3 can be increased greatly even with a small clamping force. Therefore, the locking screw 37 can be operated manually for obtaining enough clamping effect. There is no need to use tools such as drivers etc.

As has been described above, the tremolo unit mechanism for an electric guitar of the present invention is capable of maintaining the desirable pitch without becoming out of tune even with the vigorous arming, etc. It is also simple in structure. With increase in distance between the locking screw and the swinging fulcrum for the rocker arm, the clamping force required for obtaining the strong pressing force onto the string can be reduced. Consequently, the locking screw can be operated by hand without using a driver, etc. Besides, as the string inserting hole formed in the bridge body is opened at its one end to the upper surface of the bridge body while it is opened at its other end to the backside of the bridge body, stretching of the string can be performed on the upper side surface of the guitar body.

Such advantageous features as mentioned above contribute to improvements in operability of the guitar as a musical instrument as well as in efficiency in handling it. Thus, the tremolo unit mechanism provided by the present invention is remarkably great in its effects in practical use.

Figure 5:
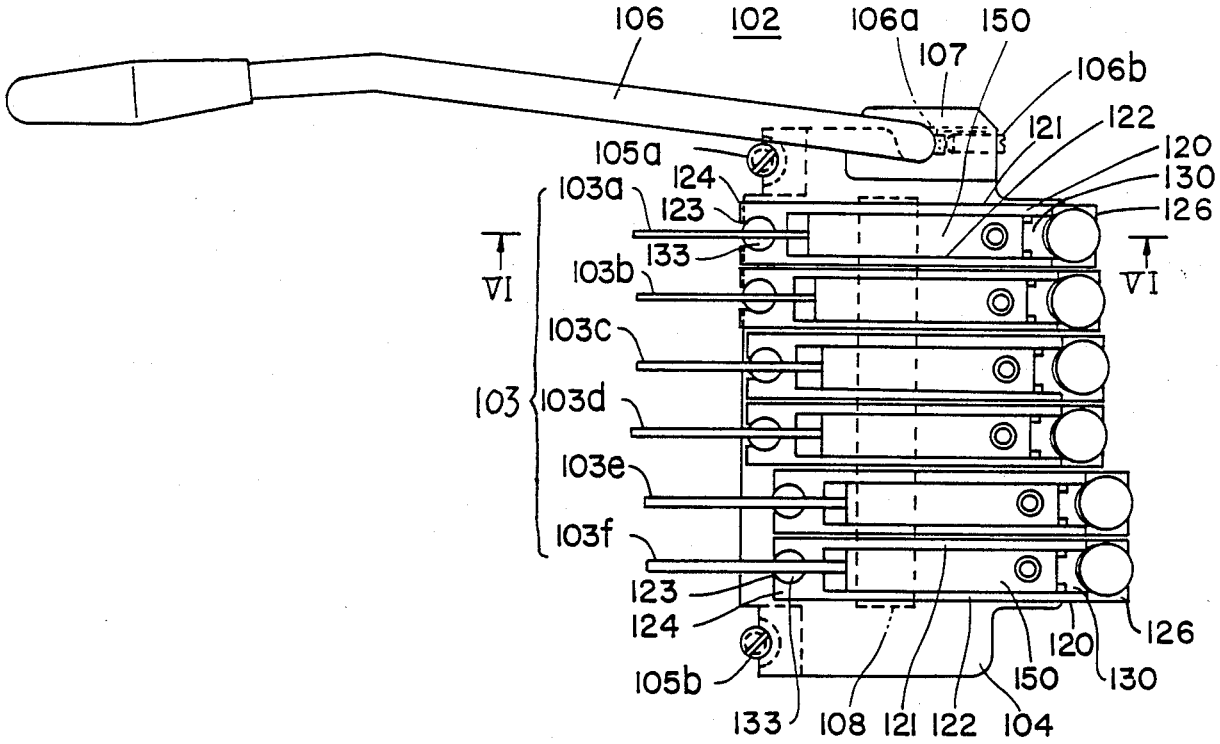
FIG. 5 is a plan view of a tremolo apparatus as another embodiment of the present invention, the apparatus being equipped with fine tuning function.
Figure 6:
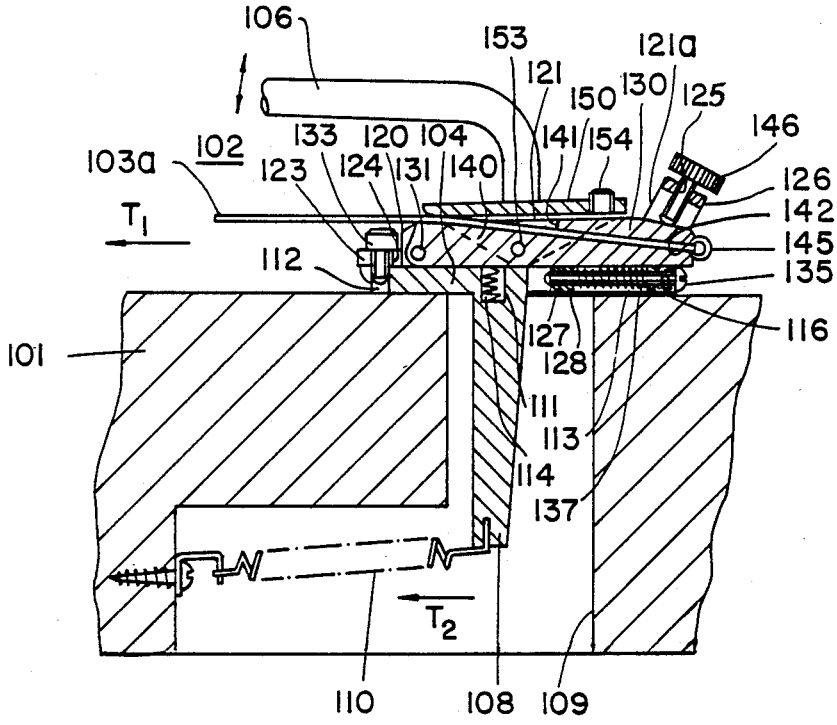
FIG. 6 is a sectional view taken along the line VI—VI in FIG. 5.
Figure 7:
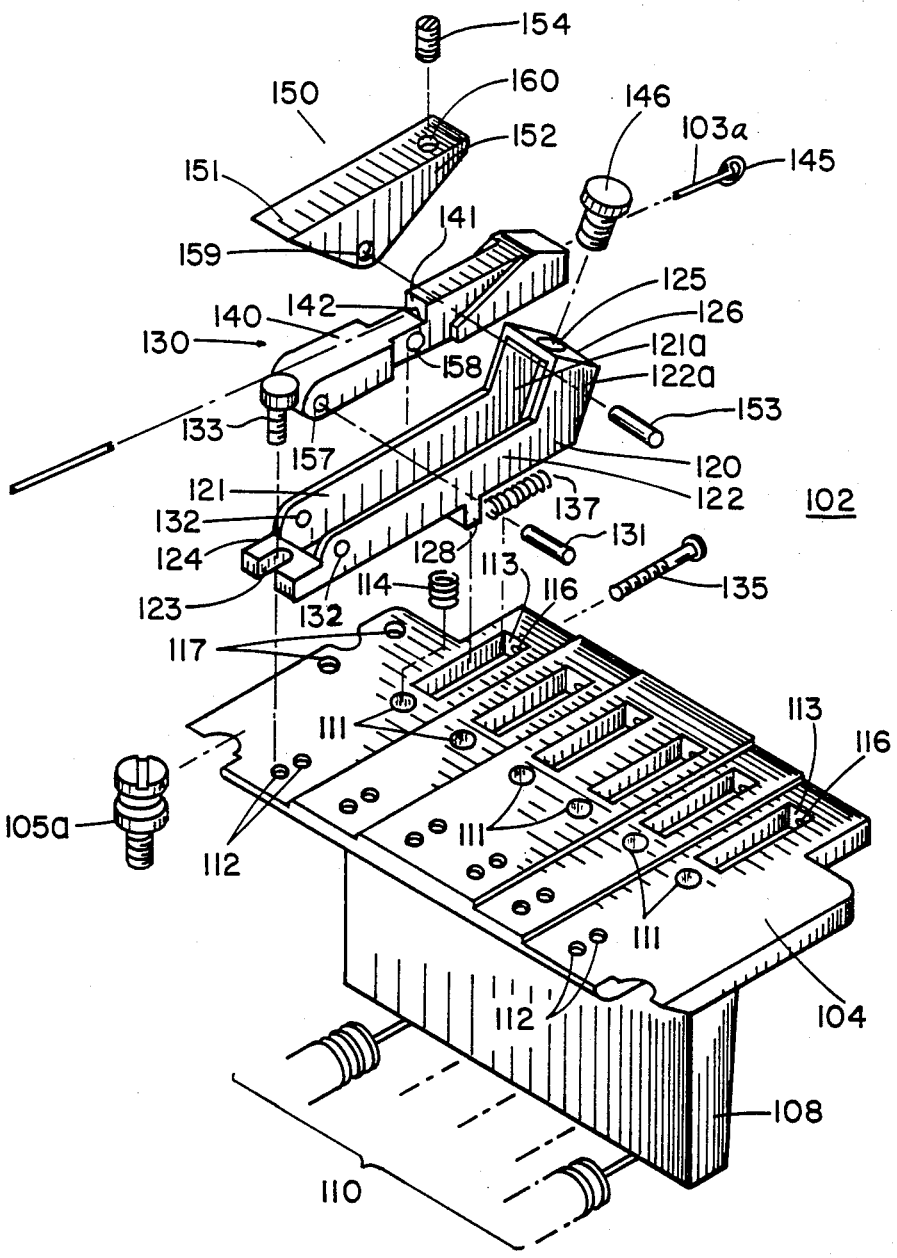
FIG. 7 is an exploded perspective view of the main components of the tremolo apparatus shown in FIG. 5.

FIG. 5 is a plan view showing a tremolo unit mechanism as another embodiment according to the present invention. FIG. 6 is a sectional view taken along the line VI—VI in FIG. 5. FIG. 7 is an exploded perspective view of the main component members of the tremolo unit mechanism in FIG. 5. In these Figures, the numeral 101 is a body of an electric guitar. On the top face (surface) of the body 101, a tremolo unit mechanism 102 for holding the one end of a plural number of strings 103, six for example, of strings 103*a* through 103*f* is disposed.

This tremolo unit mechanism 102, including a bridge base 104 is formed into approximately a T-shape and disposed on the body 101 of the electric guitar to swing optionally in a vertical direction. The bridge base 104 is kept, at its both sides along the front edge in contact with a pair of right and left columns 105*a* and 105*b* which are planted onto the above-mentioned body 1. By the foregoing contact with the columns 105*a* and 105*b*, the bridge base 104 is restricted and prevented against movement toward the neck (not shown in the Figures) of the electric guitar.

At the edge on one side, for example, on the first strings 103*a* side, of the bridge base 104, an arm block 107 is screwed on. To this arm block 107, a tremolo arm 106 is fixed, with a plastic bushing 106*a* as well as a screw for controlling the rotational torque of the arm 106*b* provided in between.

Also, at the center of the underside of the bridge base 104, a plate-form spring anchoring portion 108 is provided to be extended downward from the foregoing center area of the underside of the bridge base 104. This spring anchoring portion 108 is inserted to and positioned in a spring housing chamber 109 formed in the body 101. To the lower end of the spring anchoring portion 108, one end of balancing springs 110 in number of, for example five, are anchored respectively. By means of these springs 110, the bridge base 104 is provided with the swinging momentum (propensity) in clockwise direction (in FIG. 6), with a pair of columns 105*a* and 105*b* serving as supporting points for swinging.

The bridge base 104 is also provided with six spring housing recesses 111, six pairs of front and rear tapped holes 112 which are twelve in total, and six long holes 113 which are long in the extended direction of the strings. These spring housing recesses 111, tapped holes 112 and long holes 113 are formed to correspond to the respective strings 103*a* through 103*f*. The spring housing recesses 111 are formed at the longitudinal center in a string stretch direction of the bridge base 104 and open to the upper surface of the longitudinal center area. These spring housing recesses 111 accommodate springs 114 in them. The tapped holes 112 are formed at the front end area of the bridge base 104, while the long holes 113 are formed at the rear end area of the bridge base 104.

At the backside of the bridge base 104, screw fitting holes 116 which are opened to the foregoing long holes 113, respectively, are formed.

The top surface of the bridge base 104 is formed to have stepped surfaces. Specifically, the center step corresponding to the third and fourth strings 103*c* and 103*d* is the highest in level, and the middle steps corresponding to the second and fifth strings 103*b* and 103*e* are slightly lower than the above-mentioned center step in level. The end steps on both sides which correspond to the first and sixth strings 103*a* and 103*f* are made a little lower than the foregoing middle steps in level.

Both side areas along the front end surface of the bridge base 104 with which the columns 105*a* and 105*b* contact are formed into semicircular shapes as shown in FIG. 7. These semicircular portions of the bridge base 104 are cut slantingly toward the rear, thereby forming sharp edges, respectively. Therefore, the foregoing semicircular edges are in linear contact with the columns 105*a* and 105*b*. Numerals 117 are through holes and screws (not shown in the Figure) for fixing the arm block 107 are screwed into the holes 117 from the underside of the bridge base 104.

On the bridge base 104 thus constructed, octave (harmonic) tuning members 120 are disposed by corresponding to the respective strings 103*a* through 103*f*. Each octave tuning member 120 is formed into a frame shape which is long in string stretching direction. The octave tuning member 120 includes a pair of right and left side plates 121 and 122, a first coupling portion 124, a second coupling portion 126, and a third coupling portion 128.

The foregoing side plates 121 and 122 are facing to each other, and they have, at their rear ends, bent portions 121*a* and 122*a* which are extended upward slantingly. The first coupling portion 124 has a U-shaped groove 123, and it serves to connect the front ends of the above mentioned one pair of side plates 121*a* and 122*a*. The second coupling portion 126 has a tapped hole 125, and it serves to connect the top ends of the foregoing one pair of bent portions 121*a* and 122*a*. The third coupling portion 128 has a tapped hole 127, and it serves to connect approximately the center area of the underside of the foregoing one pair of side plates 121 and 122.

At the front end portions of the aforementioned one pair of side plates 121 and 122, small holes 132 for supporting the ends of a pin 131 are formed, respectively. The pin 131 holds a string holding member 130 that will be mentioned later. To the U-shaped groove 123 of the first coupling portion 124, a set screw 133 is inserted. This set screw 133 is screwed into either one of a pair of front and back tapped holes 112 which are formed at the front end portion of the bridge base 104 as mentioned above. In this manner, the previously mentioned octave tuning member 120 is fixed onto the bridge base 104.

The third coupling portion 128 projects downwardly from the undersides of the foregoing one pair of side plates 121 and 122. This third coupling portion 128 is inserted into the long hole 113 of the bridge base 104. Then, the third coupling portion 128 and the bridge base 104 are connected to each other by means of an octave tuning screw 135 which is screwed into the tapped hole 127 through the screw fitting hole 116. This fitting hole 116 is formed at the backside of the bridge base 104 as mentioned above, and when this octave tuning screw 135 is rotated for tuning, while the set screw 133 is held loosened, the octave tuning member 120 is adjusted in its movement in the longitudinal direction, that is, in the lengthwise direction of the string 3. Thus, highly accurate tuning is made possible.

A spring 137 is disposed in the long hole 113 in a form of being inserted over the octave tuning screw 135. The spring 137 provides the frontward momentum for the octave tuning member 120.

The string holding member 130 mentioned above is formed into a longitudinally long bar shape. It is inserted into and positioned at the space between the one pair of side plates 121 and 122 of the octave tuning member 120. The front end of the string holding member 130 is held by the pin 131 to pivot up and down.

The front half of the upper surface of the string holding member 130 is formed into a slope 140. The slope 140 is in a manner that the thickness of the front end portion is gradually reduced toward the center. To a rising wall 141 rising from the end of this slope 140, one end of a string inserting hole 142 is opened. The other end of the string inserting hole 142 is opened to the back of the string holding member 130. The slope 140 and the string inserting hole 142 have the same inclination, and also they are designed such that the lower end of the string inserting hole 142 and the surface of the slope 140 lie flush in one plane.

For installing the string 103, it is merely inserted into the string inserting hole 142 from the backside of the string holding member 130. The front end of the inserted string 103 is wound up onto the tuning peg (not shown in the Figures) of the neck of the guitar. When the string 103 is wound up by the tuning peg into the desired tension, the string 103 is tuned to the preferred pitch.

In this case, the string 103 is prevented from slipping off the string inserting hole 142 by means of a ball end 145 that is attached to the terminal end of the string 103. Also, the swinging movement of the string holding member 130 in the counterclockwise direction wound (in FIG. 6) which is caused by tensile force of the string 103, is blocked by a tuning screw 146. This tuning screw 146 is screwed into the tapped hole 125 of the second coupling portion 126, and its end comes into contact with the upper surface of the rear end portion of the string holding member 130.

At the same time, the string holding member 130 is provided with counterclockwise rotational momentum by means of the spring 114 that is held in the spring housing recess 111 of the bridge base 104. This spring 114 is effective for preventing the string holding member 130 from becoming uneven (loosened) when the string 103 ia loosened or detached.

The string holding member 130 is provided with a rocker arm 150 for locking the string 103. The rocker arm 150 is formed with a base plate 151 and a pair of right and left side plates 152. The base plate 151 has a locking screw 154 provided at its rear end portion, and it covers the upper surface of the string holding member 130. A pair of right and left side plates 152 are integrally formed on both side of the base plate 151, in a manner that these side plates 152 extend downward along the side surfaces of the string holding member 130. Because the structure as mentioned above, the rocker arm 150 has an appropriately ⊐-shape in the sectional view. The lower end portions of the side plates 152 of the rocker arm 150 are pivotally supported by the string holding member 130 by means of a shaft 153.

When the locking screw 154 is screwed in, its end comes into contact with the upper surface of the rear side portion of the string holding member 130. If the locking screw 154 is further screwed in (turned), the rocker arm 150 rotates in the counterclockwise direction according to FIG. 6 around the shaft 153. As a result, the front end of the base plate 151 of the rocker arm 150 rotates in the counterclockwise direction according to FIG. 6 around the shaft 153. As a result, the front end of the base plate 151 of the rocker arm 150 presses the string 103 against the front upper surface of the string holding member 130. Thus, the string 103 is locked.

In FIG. 7, the numeral 157 is a through hole for inserting the pin 131. The numerals 158 and 159 are through holes for inserting the shaft 153, and 160 is a tapped hole whereto the locking screw 154 is screwed in.

In the tremolo unit mechanism 102 thus constructed, the counterclockwise moment T1 is FIG. 6 is balanced at a certain level with the clockwise moment T2. The counterclockwise moment T1 is given by the sum total of the tensile force of the respective strings **103*a* through 103*f*, while the clockwise moment T2 is derived as the sum total of the spring forces of five balancing springs 110**.

By the balance obtained as mentioned above, the bridge base 104 is held in a state that it is in light contact with the body 101, or it is poised at a certain angle and positioned to be somewhat lifted over the body 101. In this state, when the tremolo arm 106 is moved up and down during the guitar play, the above mentioned balanced state is lost and the tensile forces of the respective strings **103*a* through 103*f*** are varied, whereby giving the tremolo effect.

In this case, since the string 103 is locked by the rocker arm 150, it seldom occurs that the tuning is distorted into out of tune. However, it is still possible that the strings become out of tune by some reasons such as vigorous arming, etc. In such case, when the tuning screw 146 is tuned, the string holding member 130 is rotated clockwise according to FIG. 6 against the tensile force of the string 103 as well as the spring force of the spring 114, the string 103 becomes pulled tight. In this manner, the string 103 can be brought back to be in tune.

This re-adjustment of tuning can be carried out without releasing the locking of the string 103 effected by the rocker arm 150. Accordingly, the handling for such adjustment is simple, and the fine adjustment is also made possible.

In addition, the tuning screw 146 is prevented from getting loosened during the play of the guitar causing the guitar to become out of tune. The reason for this is that the string holding member 130 is kept pressed to contact with the tuning screw 146 from below due to the tensile force of the string 103. Another reason is that the tuning screw 146 is set not too tightly but not too loosely against the tapped hole 125. Besides the installing of the string 103 can be carried out easily since the string 103 is inserted into the string inserting hole 142 from the upper surface side of the body 101 without turning over the guitar body 101.

In the above embodiment, five balancing springs 110 are used for providing the balance of the bridge base 104 against the moment brought about by the tensile force of the string 103. It is obvious, however, that the present invention is not limited to the foregoing embodiment. The number of the balancing springs may be increased or decreased depending on the necessity.

Also, in the foregoing embodiment, the tuning screw 146 is provided on the octave tuning member 120. However, it may be provided in the bridge base 104. In this case, the bent portions **121*a* and 122*a* and the second coupling portion 126 of the octave tuning member 120** are not necessary. Instead, an approximately ⊟-shape portion that corresponds to the above mentioned portions 121*a*, 122*a*, and 126 may be provided in the bridge base 104. This portion is for fitting the screw 146 in lieu of the bent portions 121*a* and 122*a*, and the second coupling portion 126 of the octave tuning member 120.

As should be apparent from the foregoing description, the tremolo unit mechanism for an electric guitar of this embodiment prevents the strings from getting out of tune. Also, when the string holding member is rotated by using the tuning screw, the tensile force of the string can be varied and the fine tuning adjustment becomes feasible. Besides, this tuning operation can be performed easily in short time since it does not require to release the locking of the string.

Furthermore, the string inserting hole is formed in the string holding member and is opened to the top surface side at its one end, while it is opened to the backside at its other end. Consequently, the installation of the string can be carried out on the upper surface side of the guitar body.

These meritorious features of the tremolo unit mechanism enhance the operability of the guitar for musical instruments and also facilitates the handling for tuning of the guitar strings. Thus, the present invention provides a great deal of effects in its actual use.

Figure 8:
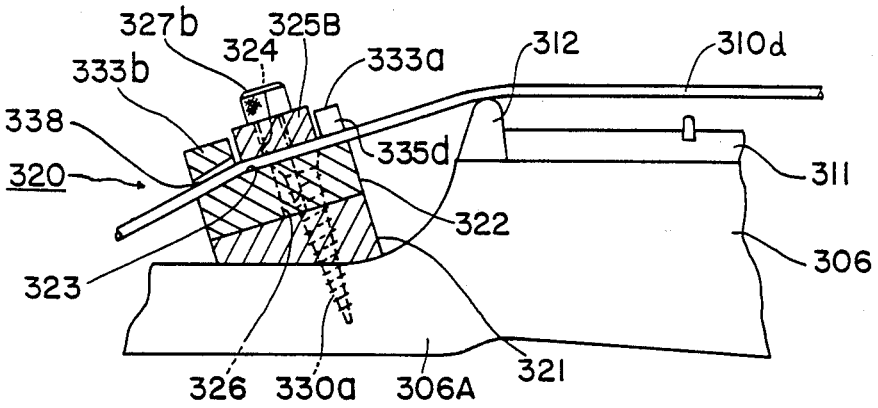
FIG. 8 is a sectional side elevational view of a string locking device as an embodiment of the present invention.
Figure 9:
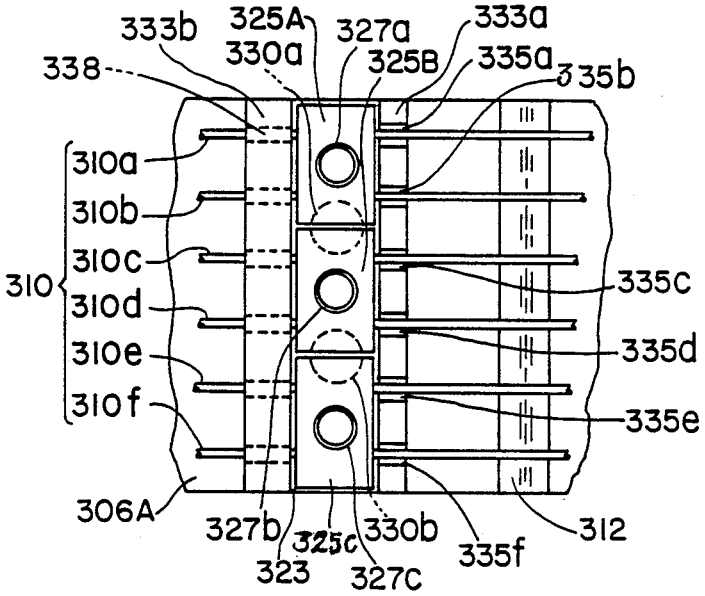
FIG. 9 is a plan view of the string locking device shown in FIG. 8.
Figure 10:
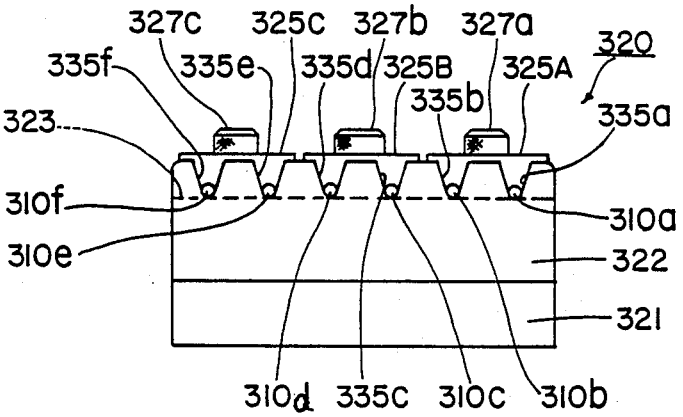
FIG. 10 is a front view of the string locking device shown in FIG. 8.

FIG. 8 is a sectional side view of an embodiment of a string locking device 320 used together with the tremolo apparatus provided by the present invention. FIG. 9 is a plan view thereof and FIG. 10 is a front view thereof.

In the Figures, the string locking device 320 locates on the top surface of the head portion 306A of a neck 306, and between a top fret 312 and tuning pegs which are not shown in the Figures. The numeral 311 is a finger board provided on the upper surface of the neck 306. The foregoing string locking device 320 basically includes a spacer 321, a string locking body 322, three presser blocks 325A, 325B, and 325C and clamp screws 327*a*, 327*b* and 327*c*.

The spacer 321 is fixed onto the top surface of the head portion 306A. The string locking body 322, formed into a ⊔-shape in its section has a long groove 323 which is formed along the upper surface of the string locking body 322. The long groove 323 runs in the direction crossing at right angles with the strings 310. The string locking body 322 has the size enough to commonly support all of the strings 310 (310*a* through 310*f*).

The presser blocks 325A, 325B and 325C are provided with through holes 324, respectively. These three presser blocks 325A, 325B and 325C are loosely or adjustably placed in the long groove 323, and respectively press the two strings next to each other, that is, the strings 310*a* and 310*b*, 310*c* and 310*d*, and 310*e* and 310*f*, at the same time. Corresponding to the respective presser blocks 325A, 325B and 325C, the clamp screws 327*a*, 327*b* and 327*c* are respectively screwed into tapped holes 326 formed at the bottom of the long groove 323. These clamp screws 327*a*, 327*b* and 327*c* fasten the presser blocks 325A, 325B and 325C, respectively, The foregoing spacer 321 is provided in order to adjust the height of the string locking body 322, so that the portion of the string between the top fret 312 and a string guiding through hole 338 that will be mentioned later becomes straight linear in state. The spacer 321 is firmly fixed onto the upper surface together with the above mentioned string locking body 322 of the head portion 306A by means of a pair of screws 330*a* and 330*b*.

In this case, the length between the upper surface of the head portion 306A and the upper surface of the top fret 312 varies depending on the type of electric guitar. Therefore, for the spacer 321, it is preferable to prepare in advance several types of spacers with various heights and select the one with optimum dimension from those prepared, or to plane a spacer into optimum dimension with respect to its plate thickness. Also, the portion of the string 310 between the top fret 312 and the bridge provided on the guitar body (not shown in the Figures) is the effective string length for vibration. Accordingly, the bottom surface of the long groove 323 is designed to be located at the level lower than the upper surface of the foregoing top fret 312.

On the upper surface of the string locking body 322, a pair of front and rear side walls 333*a* and 333*b* which form the long groove 323 are provided as integral parts of the string locking body 322. Of the foregoing one pair of side walls 333*a* and 333*b*, the side wall 333*a* on the front side is provided with approximately V-shape grooves 335*a* through 335*f* which are formed along the upper surface of the side wall 333*a* to correspond to the respective strings 310*a* through 310*f*. These grooves 335*a* through 335*f* are opened to the long groove 323, respectively, and their bottom surfaces and the bottom surface of the long groove 323 lie flush in one plane.

On the other hand, the side wall 333*b* on the rear side is provided with six string guiding through holes 338 which respectively open to the long groove 323. These string guiding holes 338 correspond to the strings 310*a* through 310*f*, respectively, in number. Also, these string guiding holes 338 are tilted in order to direct or bend the string 310 toward the head portion 306A. The end portions of the strings 310*a* through 310*f* which are pulled from the respective V-shape grooves 335*a* through 335*f*, the long groove 323, and the guiding holes 338 are wound onto the tuning pegs which are not shown in the Figures, and anchored by them.

In the string locking device 320 mentioned above, when the presser blocks 325A, 325B and 325C are pressed down by tightening the respective clamp screws 327*a*, 327*b* and 327*c*, the portions of the strings 310*a* through 310*f* which are inserted in the long groove 323 are locked pressed onto the bottom of the long groove 323.

In this case, when the height of the top surface of the top fret 312 is represented by A, the height of the bottom surface of the grooves 335*a* through 335*f* is set to be B, and the height of the open end of the string guiding holes 338 on the top fret 312 side is set to be C, the requirement of $A>B>C$ is met, and also, the A, B and C are on the same inclined straight line. Therefore, no gap is formed between the bottom surface of the long groove 323 and the string 310, and the loosening of the string 310 can be prevented.

Furthermore, the approximately V-shaped grooves 335*a* through 335*f* are formed in the side wall 333*a* on the front side by corresponding to the respective strings 310*a* through 310*f*. The bottom surface of the grooves 335*a* through 335*f* and the bottom surface of the long groove 323 lie flush in one plane. Therefore, it is possible to check if any gap occurs between the bottom surface of the long groove 323 and the string 310, through the foregoing grooves 335*a* through 335*f*.

As has been described above, the string locking device for electric guitars of the present invention through the V-shape grooves makes it easy to see if any gap is formed between the bottom surface of the long groove and the strings. In addition, by adjusting the mounting height of the string locking body by the spacer, the reaction force of the string against the presser block can be eliminated. As a result, the loosening of the string, in other words, the derangement in pitch (interval) into out of tune, can be prevented.

I claim:

1. A tremolo unit mechanism for electric guitar comprising:

a bridge base mounted on a guitar body, said bridge base being pivotally movable up and down with its front edge serving as fulcrum for such pivotal motion;

bridge bodies respectively provided on said bridge base by corresponding to respective strings, each one of said bridge bodies having a string inserting hole which, formed in the rear end portion of the bridge body, opens at its one end to the surface on the upper side while at the other end to the back of the bridge body;

octave tuning screws which move said bridge bodies in the length wise direction of the strings to effect harmonic tuning;

rocker arms mounted on the bridge bodies in a manner to pivotally move in a vertical direction, said rocker arms covering the upper surface of said bridge bodies and pressing the front end portions the strings, which are led out from said string inserting holes, onto the upper surfaces of the front end portion of the bridge bodies;

locking screws screwed into the rear end portion of said rocker arms, the front ends of the locking screws coming into contact with the top surfaces of the rear end portions of said bridge bodies; and balancing springs for providing said bridge base with balancing moment in a direction opposite to a moment derived from the tensile force of the strings.

2. A tremolo unit mechanism according to claim 1, wherein each one of said rocker arms includes a top plate and side plates formed substantially in a reversed U-shape in cross section and is pivotally mounted on said bridge bodies by a shaft, a string is locked by the front end of said top plate of the rocker arm when said locking screw is screwed in and the front end rotates around said shaft.

3. A tremolo unit mechanism according to claim 1, wherein said bridge bodies is formed with a raised portion at the rear end and a string inserting hole is provided in the raised portion, one end of said hole opens to a front of said raised portion and the other end opens to a rear of the raised portion.

4. A tremolo unit mechanism according to claim 1, further including an octave adjustment screw provided in said bridge base, said octave adjustment screw being connected to said bridge bodies such that said screw, when turned, moves said bridge bodies in the lengthwise direction of the string.

5. A tremolo unit mechanism according to claim 2, wherein said string is prevented from slipping off of the string holding member by said side plates of said locker arm.

6. A tremolo unit mechanism for electric guitar comprising:

a bridge base mounted on a guitar body, said bridge body being allowed to pivot movably up and down around the front edge as a supporting point for the movement;

octave tuning members disposed on said bridge base corresponding to strings, respectively;

octave tuning screws for moving said octave tuning members in a lengthwise direction of the strings to accomplish harmonic tuning;

string holding members disposed repectively on said octave tuning members in a manner to pivot in a vertical direction, each of said string holding members having a string inserting hole which opens at its one end to the upper surface of the string holding member while an other end opening to the backside of the string holding member;

rocker arms pivotally disposed respectively onto said string holding members, said rocker arms locking the strings which are led to the upper surfaces of the string holding members out of said string inserting holes;

locking screws pressing said rocker arms against upper surfaces of said string holding members;

tuning screws restraining said string holding members from being rotated upward due to a tensile force of the strings; and balancing springs for providing said bridge base with a balancing moment in the direction opposite to that of the moment resulting from the tensile force of the strings.

7. A tremolo unit mechanism according to claim 6, wherein each one of said rocker arms includes a top plate and side plates formed substantially in a reversed U-shape in cross section and is pivotally mounted on said bridge bodies by a shaft, a string is locked by the front end of said top plate of the rocker arm when said locking screw is screwed in and the front end rotates around said shaft.

8. A tremolo unit mechanism according to claim 6, wherein said string holding member is formed with a raised portion at the rear end and a string inserting hole is provided in the raised portion, one end of said hole opens to a front of said raised portion and the other end opens to a rear of the raised portion.

9. A tremolo unit mechanism according to claim 6, further including an octave adjustment screw provided in said bridge base, said octave adjustment screw being connected to said octave tuning member such that said screw, when turned, moves said octave tuning member in the lengthwise direction of the string.

10. A tremolo unit mechanism according to claim 7, wherein said string is prevented from slipping off of the string holding member by said side plates of said locker arm.

11. A string locking device for electric guitar comprising:

a spacer provided on an upper surface of the head of said guitar;

a string locking body disposed on said spacer, said string locking body being substantially ⊔-shaped in section and having a pair of front and rear side walls projecting upward from the upper surface of the string locking body and having a long groove formed between said side walls in a form extending in a direction to cross at right angle with strings;

substantially V-shaped grooves formed on said front side wall to hold the strings, the lower surface of said V-shaped grooves and the bottom of said long groove lie flush in one plane so that said V-shaped grooves communicate with said long groove;

string guiding holes formed in the rear side wall of said string locking body and communicating with said long groove, said string guiding holes slanting to bring the strings close to the surface of the head; and presser blocks loosely provided in said long groove, said presser blocks fixing the strings positioned in said long groove.

12. A string locking device for electric guitar according to claim 11, further comprising a tightening screw mounted on each of said presser blocks, said presser blocks firmly fixing the strings in said long groove when said tightening screw is screwed in.

13. A string locking device for electric guitar according to claim 11, wherein said V-shaped grooves and long groove lie flush on one plane such that the string locating between the nut and the long groove is stretched straight.

14. A string locking device for an electric guitar according to claim 11, wherein said nut, V-shaped groove, long groove, and string guiding hole are arranged lower in height than each of the previous one.

* * * * *